United States Patent [19]

Bennison

[11] 4,359,009

[45] Nov. 16, 1982

[54] MEANS FOR TURNING JIGS ON SEWING MACHINES

[75] Inventor: Michael N. Bennison, Bardsey, England

[73] Assignee: AMF Incorporated, White Plains, N.Y.

[21] Appl. No.: 187,398

[22] Filed: Sep. 15, 1980

[30] Foreign Application Priority Data

Sep. 14, 1979 [GB] United Kingdom ..... 7931890

[51] Int. Cl.[3] ..... D05B 21/00

[52] U.S. Cl. ..... 112/121.12; 112/102

[58] Field of Search ..... 112/121.12, 121.11, 112/121.15, 102, 153, 308, 309

[56] References Cited

U.S. PATENT DOCUMENTS

| | | | |
|---|---|---|---|
| 3,439,637 | 4/1969 | Haselgrove et al. | 112/121.12 |
| 3,650,229 | 3/1972 | Rovin | 112/308 X |
| 3,680,508 | 8/1972 | Baig et al. | 112/121.12 |
| 4,141,304 | 2/1979 | Masuda | 112/308 X |
| 4,312,281 | 1/1982 | Doyen et al. | 112/153 X |

FOREIGN PATENT DOCUMENTS

| | | | |
|---|---|---|---|
| 2825530 | 12/1979 | Fed. Rep. of Germany | 112/121.12 |
| 1187591 | 4/1970 | United Kingdom | 112/121.11 |
| 1371061 | 10/1974 | United Kingdom | 112/121.12 |

*Primary Examiner*—H. Hampton Hunter

*Attorney, Agent, or Firm*—David E. Dougherty; Charles J. Worth

[57] ABSTRACT

In a sewing machine adapted to stitch a garment panel held in or on a jig which is to be passed through the machine and turned in its own plane at a corner thereof, means are provided for detecting the approach of the corner and auxiliary means operative to assist in the turning of the jig at the corner.

6 Claims, 3 Drawing Figures

MEANS FOR TURNING JIGS ON SEWING MACHINES

This invention relates to improvements in or relating to the profile stitching of sheet material particularly but not exclusively garment parts.

It has previously been proposed to manufacture garment parts by securing two or more garment panels in face to face relationship in or to a jig or template and guiding the template beneath the needle of a sewing machine so that the panels are sewn together along a desired stitching line or profile, the template having for this purpose means defining a guide surface corresponding to the desired stitching line and the sewing machine having a stationary guide element for engagement with the said surface and means for moving the template under the needle so that the guide element runs relatively along the surface. Effective as the technique is in producing stitch lines that are straight or have curves of large radius, problems have arisen in trying to produce stitch lines of relatively small radius of curvature particularly with relatively large templates, and it is an object of the invention to obviate these problems.

According to the invention there is provided in a sewing machine for use in association with a template having means defining a guide surface corresponding to a desired stitching profile, said sewing machine comprising a stationary guide element for engagemet with said guide surface of the template and means for moving the template under the needle of the sewing machine with the guide surface running past said guide element, an improvement comprising means for detecting curvature in a portion of said guide surface in advance of its engagement with said guide element and means operative on detection by said detecting means of curvature of predetermined magnitude to exert a turning force on said template so as to assist in moving the curved portion of said guide surface past the guide element.

Preferably, where the outer edge of the template is parallel to said guide surface, the means for detecting curvature comprises means for detecting the departure of said edge from the position it would occupy were the guide surface straight for a predetermined distance ahead of the guide element.

Preferably again the means for assisting the movement of the curved portion of the guide surface past the guide element comprises an arm mounted for arcuate movement about a vertical axis through the guide element. The means for detecting curvature may also be arranged to reduce the rate of reciprocation of the needle and may also be arranged simultaneously to increase the distance by which the template is moved during each stitch.

The rate of reciprocation may be reduced until the needle is stationary.

Embodiments of the invention will now be described by way of example and with reference to the accompanying drawing of which:

Figure 1:
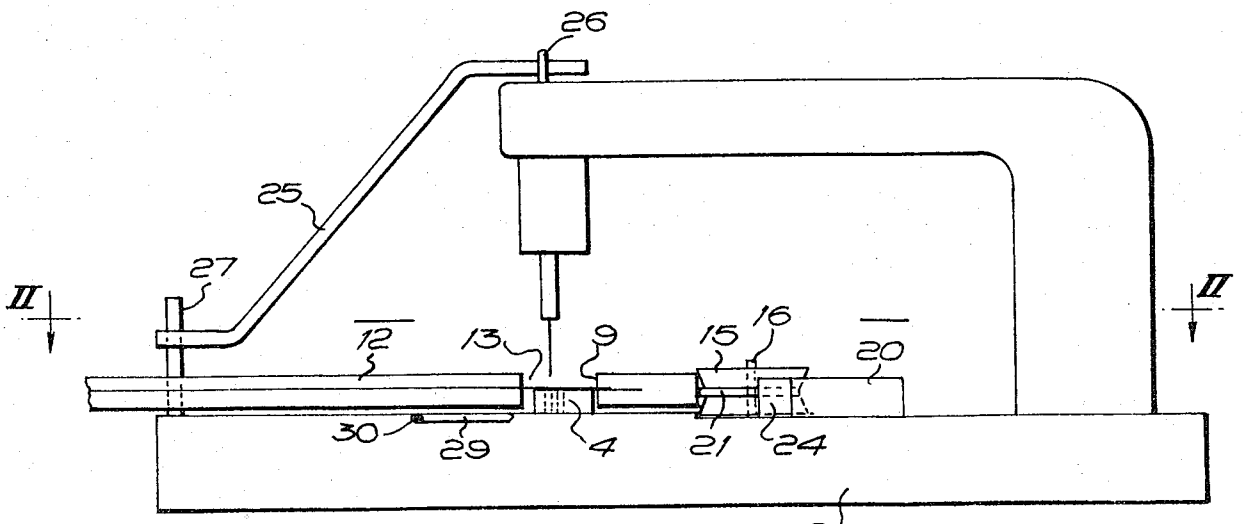
FIG. 1 is a side elevation of a sewing machine in operative relationship with a template.

As shown in the figures a sewing machine 1 comprises a base 2 above which a needle head 3 is supported by a cantilever arrangement. A guide element 4 is supported on the base 2 in such a position that a hole 5 therein lies in the path of movement of a vertically reciprocating needle, whilst slot 6 similarly lies in the path of a vertically reciprocating trimming blade (not shown) associated with the needle.

The guide element 4 projects as a stud above the base 2 and in use is located in a parallel sided slot 10 in a template 12 and in engagement with edge 9 thereof, said template being arranged to support one or more layers of fabric 13.

A vee-grooved wheel 15 rotatably mounted on the base 2 for rotation about vertical axis 16 in the direction shown by arrow 17 is urged by conventional means not shown into engagement with outer edge 11 of template 12 which edge is parallel to edge 9 which in part defines slot 10. The face 7 of stud 4 which engages with edge 9 is part circular, the hole 5 lying at the centre of curvature. The radius of curvature corresponds to the minimum generally acceptable in the edge 9 of any template suitable for use with the sewing machine, and is kept small so as to enable a sharp cornered profile to be followed.

A vertical pivot 26 is provided on the sewing machine head vertically above stud 4, and a sweep arm 25 is arranged to be moved in a direction anticlockwise in FIG. 1 about that pivot.

The arm 25 has a downwardly inclined portion and a lower horizontal portion which supports a rod 27 which is free to slide vertically and in use rests with its lower end resting on the sewing machine base 2 or on a table or other surface substantially coplanar with base 2 provided for the support of the template 12.

To the front of the wheel 15 there is located a housing 20 which accommodates an electrical switch 24 operated by a spring loaded plunger 21. When, under influence of the spring, plunger 21 projects beyond line 22, an electrical circuit is completed which is arranged to actuate arm 25 so that this turns about vertical pivot 26 so that rod 27 engages with edge 8 of template 12 and imparts a turning action thereto about the stud 4. If the template is provided with an upstanding post 18, the arm 25 may be arranged to bear directly upon the post.

In use of the sewing machine described above, a template 12 supporting layers of fabric 13 is arranged with stud 4 at the end A of slot 10. The drive wheel 15 which replaces the conventional feed dogs of the sewing machine bears against edge 11 of the template so that the template is moved backwardly with the slot 10 sliding past the stud 4 with the edge 7 of the stud in engagement with edge 9 of the slot. During the movement of the template the needle and associated trimming blade of the sewing machine reciprocate vertically respectively through the hole 5 and the slot 6 causing a stitching line to be inserted in the fabric 13 along a line parallel to edge 9 and trimming the fabric between the line for stitching and the edge 9. The rotation of wheel 15 is intermittent and geared to the movement of the needle so that the template is moved only during tht portion of the stitching cycle when the needle is raised out of the fabric.

Figure 2:
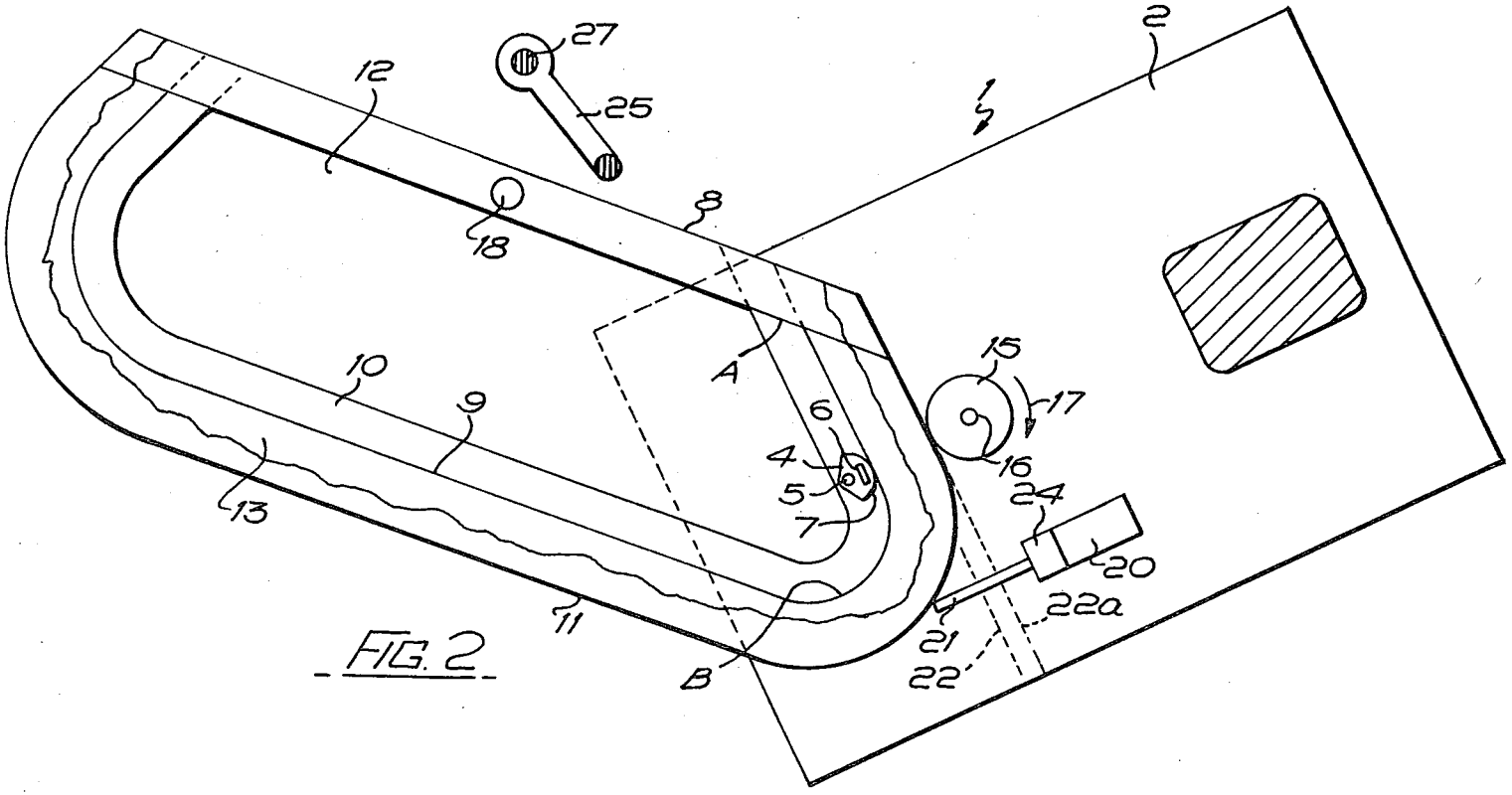
FIG. 2 is a section on lines II—II of FIG. 1.

It has been found in practice that whilst the drive wheel can move the template satisfactorily when edge 9 is straight or only slightly curved, when a curve of relatively small radius such as curve B in the Figure reaches the stud 4 the wheel 15 may not be able, unaided, to turn the template through the required angle without marked loss of speed and an undesirable cramming of the stitches, and the effect is particularly noticable if the template is large because of the greater effects of inertia and friction. To obviate this problem, the switch 24 is located so that the free end of the plunger 21 engages edge 11 on the approach to the stud 4 of a curve of predetermined magnitude, plunger 21 projects forwardly of line 22 and a turning movement is caused to be applied to arm 25 so that a turning force is applied to the edge 8 or the post 18 of the template 12. The rate of movement of arm 25 is arranged in relation to the speed of rotation of wheel 15 so that the arm 25 engages with the template 12 when the beginning of the curvature detected by the switch has reached stud 4. The arm 25 maintains its pressure on the template 12 while the plunger 21 remains so projecting when the corner has been negotiated, as shown in FIG. 2, the plunger 21 is pushed by edge 11 behind line 22, the switch is broken and the arm 25 is caused to return to its original position.

The switch which causes operation of the arm 25 may also, in some embodiments, be arranged to effect a reduction in the needle speed and, independently, to vary the extent of movement of wheel 15 during each stitch. In a refinement of the equipment, the switch 24 may be a 2-position switch and different electric circuits will be completed according to the extent of projection of plunger 21 beyond line 22 so that if required a larger torque may be imparted to the template 12 by the arm 25 on approach of a curve of particularly small radius. It will be clear that by adjusting the position at which the plunger 21 makes its switch, the apparatus can be arranged not to come into operation at the approach of a curve of such large radius that the wheel 15 can function unaided.

The swing of the arm 25 is effected by a pneumatic torque unit or may be operated by other appropriate means. The use of the sweep arm 25 facilitates the use of larger templates than have been used before.

The object of the swinging arm 25 is to overcome the inertia in the template 12 when it is required to turn the template through a substantial angle. Once the template has begun to turn with the assistance of the arm 25 it may in some circumstances be necessary to provide a means for damping the momentum when the template has turned through a sufficient angle, and it may be convenient to provide a buffer in association with the housing 20 so as to absorb energy imparted by the swinging template 12 to the plunger 21 in the event that the plunger is forced back beyond line 22a. The energy absorption may be effected by a spring or, preferably, a hydraulic pneumatic damper.

Figure 3:
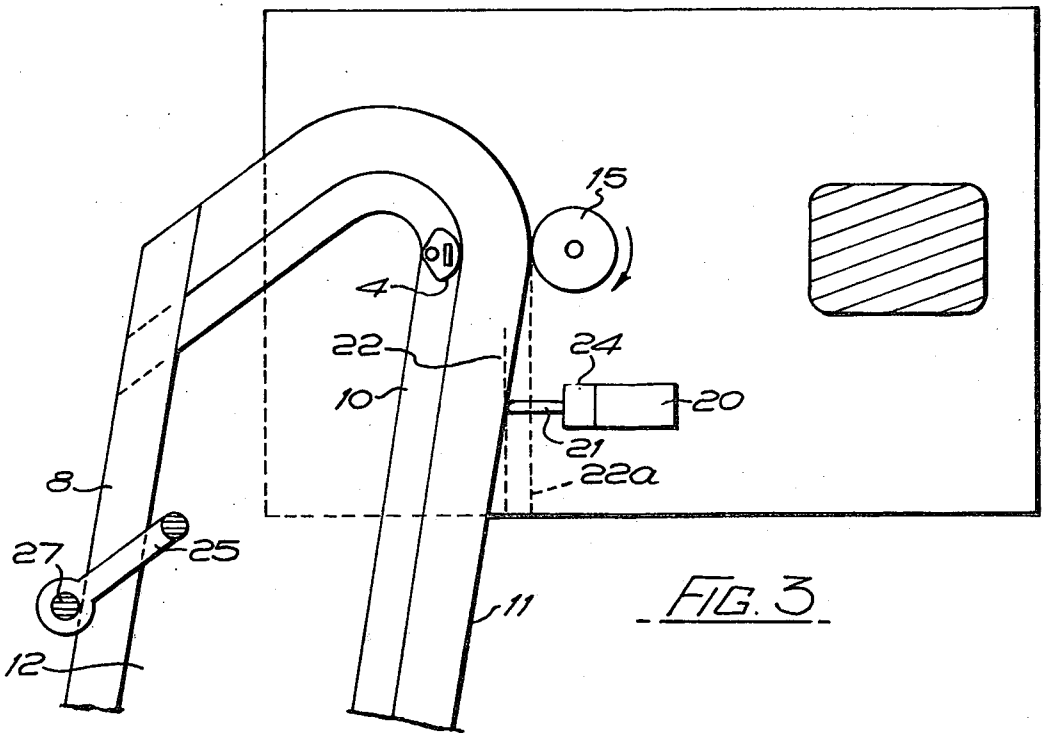
FIG. 3 is a section on lines II—II of FIG. 1 at a later stage in the sewing operation.

In order to facilitate the introduction of the slot 10 onto the stud 4, a plate 29 is provided in the base 2 of the sewing machine as shown in FIG. 3. The plate is pivoted at edge 30 and operated by air pressure to incline upwardly so as to provide a ramp reaching the level of the top of stud 4. Thus when commencing operation, the template is simply slid up the ramp so that the edge 11 slides over the top of the stud. The plunger 21 of switch 24 is arranged to be engaged by edge 11 even at this elevation and upon engagement to cause the air supply to be withdrawn from the plate so that it drops and allows the template to return to be supported on the base 2 when the stud enters slot 10.

I claim:

1. In a sewing machine for use in association with a template having means defining a guide surface corresponding to a desired stitching profile, said sewing machine comprising a stationary quide element for engagement with said guide surface of the template and means for moving the template under the needle of the sewing machine with the guide surface running past said guide element, an improvement comprising means for detecting curvature in a portion of said guide surface in advance of its engagement with said guide element and means operative on detection by said detecting means of curvature of predetermined magnitude to exert a turning force on said template so as to assist in moving the curved portion of said guide surface past the guide element.

2. An improvement in a sewing machine according to claim 1 wherein, where the outer edge of the template is parallel to said guide surface, the means for detecting curvature comprises means for detecting the departure of said edge from the position it would occupy were the guide surface straight for a predetermined distance ahead of the guide element.

3. An improvement in a sewing machine according to claim 1 wherein the means for assisting the movement of the curved portion of the guide surface past the guide element comprises an arm mounted for arcuate movement about a vertical axis through the guide element.

4. An improvement in a sewing machine according to claim 1 wherein the means for detecting curvature is arranged to reduce the rate of reciprocation of the needle.

5. An improvement in a sewing machine according to claim 4 wherein the rate of reciprocation is reduced until the needle is sationary.

6. An improvement in a sewing machine according to claim 1 wherein the means for detecting curvature is arranged to increase the distance by which the template is moved during each stitch.

* * * * *